US005301756A

United States Patent [19]

Relyea et al.

[11] Patent Number: 5,301,756

[45] Date of Patent: Apr. 12, 1994

[54] VEHICLE MOUNTED AERIAL LIFT

[75] Inventors: Robert G. Relyea, Dallas, Tex.; Edward V. Garnett, Huntington Beach, Calif.

[73] Assignee: Crash Rescue Equipment Service, Inc., Dallas, Tex.

[21] Appl. No.: 14,548

[22] Filed: Feb. 8, 1993

Related U.S. Application Data

[63] Continuation-in-part of Ser. No. 723,577, Jul. 1, 1991, Pat. No. 5,211,245.

[51] Int. Cl.[5] ..... A62C 27/00

[52] U.S. Cl. ..... 169/24; 169/70; 239/596; 239/600

[58] Field of Search ..... 169/70, 24; 239/600, 239/596

[56] References Cited

U.S. PATENT DOCUMENTS

| | | | |
|---|---|---|---|
| 2,251,175 | 7/1941 | Tappe | 169/70 X |
| 2,813,753 | 11/1957 | Roberts | 169/70 X |
| 2,857,005 | 10/1958 | Medlock | 169/70 X |
| 3,104,720 | 9/1963 | Sullivan | 169/70 |
| 3,599,722 | 8/1971 | Davidson | 169/24 |
| 3,762,478 | 10/1973 | Cummins | 169/25 X |
| 3,770,062 | 11/1973 | Riggs | 169/24 |
| 4,219,084 | 8/1980 | Gray et al. | 169/70 X |
| 4,453,627 | 6/1984 | Garnett . | |
| 4,802,535 | 2/1989 | Bakke | 169/70 |

FOREIGN PATENT DOCUMENTS

| | | | |
|---|---|---|---|
| 2150432 | 7/1985 | United Kingdom | 169/24 |

*Primary Examiner*—David M. Mitchell
*Assistant Examiner*—Gary C. Hoge
*Attorney, Agent, or Firm*—Jones, Day, Reavis & Pogue

[57] ABSTRACT

An aerial boom system for a fire-fighting vehicle which has a hollow piercing nozzle on the outer end thereof for passing through the wall of a structure such as an aircraft fuselage to the interior of the structure where a fire-retardant material may be injected. The nozzle may pierce the fuselage from a remote distance because of the extensible boom. It has thereon a torque limiter to protect the nozzle assembly when forces are applied to the nozzle assembly in a direction transverse to the piercing direction.

3 Claims, 7 Drawing Sheets

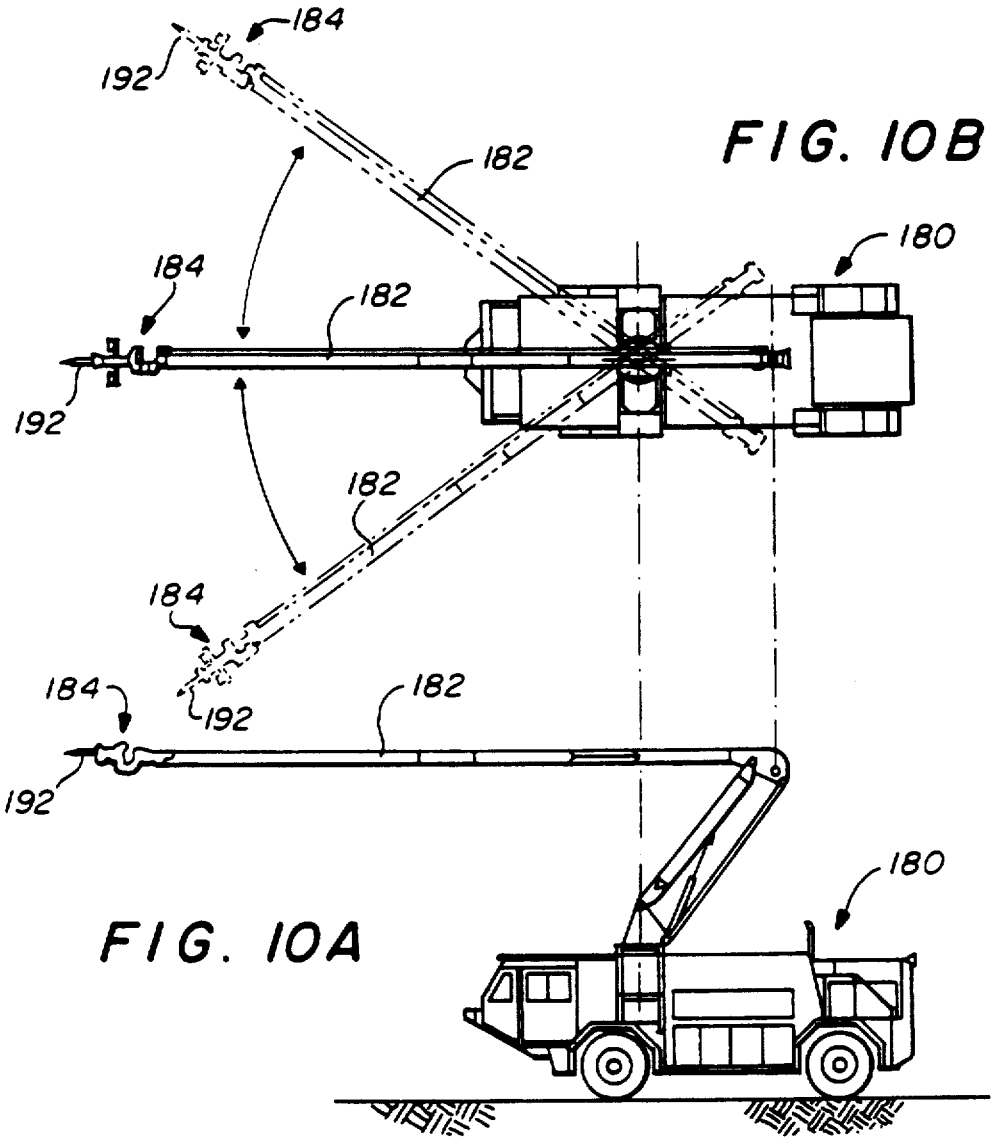
FIG. 10B
FIG. 10A
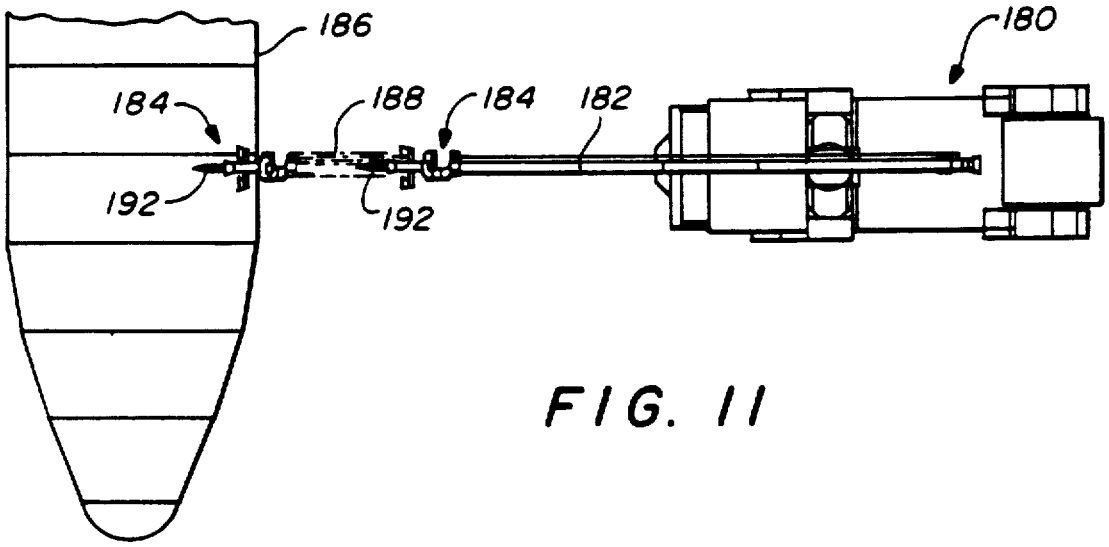
FIG. 11

VEHICLE MOUNTED AERIAL LIFT

This is a continuation-in-part of copending Ser. No. 07/723,577 filed on Jul. 1, 1991 now U.S. Pat. No. 5,211,245.

FIELD OF THE INVENTION

The present invention relates to vehicle aerial lifts in general and in particular to an aerial lift that has a boom that can be extended in front of the cab while in the resting position and which can be elevated up to a maximum height but which also can be tilted to allow the nozzles on the end of the boom to be lowered to or below ground level. In addition, the nozzle has the capability of rotating 90° either side of the center line of the boom or 225° in the vertical plane, 45° above the plane of the boom and 180° below the plane of the boom.

BACKGROUND OF THE INVENTION

Prior art aerial lifts or hydraulic platforms are of many types. In U.S. Pat. No. 4,453,672, there is disclosed an aerial lift which permits rotation about a vertical axis during use through a full 360° to any position. The lift accommodates extensions and retractions of an extensible boom formed as a part of conventional lower and upper booms. A single hydraulic cylinder raises and lowers a pair of pivotally connected lower and upper booms. The upper and lower booms are connected together such that the movement of the lower boom causes the outward end of the upper boom to move generally vertically upwardly rather than in an arc toward or away from the vehicle. A fluid supply line for a nozzle at the upper end of the lift accommodates relative movement between various parts of the lift as well as rotation of the lift to different angular positions.

One of the problems associated with the aerial lift disclosed in U.S. Pat. No. 4,453,672 is that the upper boom with the fluid nozzle at the end thereof can move only from the horizontal upwardly. It can not be tilted upwards so that the boom can be extended downwardly toward the ground. Further, the nozzle on the end of the boom can be moved in a vertical plane but it can not be directed in a horizontal plane. Thus, it is difficult to use such aerial lift for purposes such as fighting fires because the vehicle itself must be positioned in certain instances to direct the fluid flow and in other instances can not project the fluid from positions near the ground level. Further, the entire boom assembly must be rotated to aim the fluid in various directions.

It would be advantageous to have an aerial lift assembly which has an upper boom that could be tilted toward the ground as well as pivoted upwardly. It would also be advantageous to have a nozzle assembly on the outer end of the upper boom which not only could be pivoted in the vertical plane but could also be rotated in a plane perpendicular to the vertical plane.

Further, where a fire is contained within the structure, it would be advantageous to know where the fire needs control most urgently. If the hot spots were known, the fire could be attacked at those points.

Also, in remotely controlled aerial lifts, the fluid flow quantity is fixed and can be adjusted only by changing the pressure.

In addition, where the operator is sitting in a vehicle, it is sometimes difficult to have a complete view of the object containing the fire because of other objects blocking the view.

Finally, if the structure or object containing the fire is surrounded with a great deal of smoke, it is difficult to know how close the nozzle assembly of the aerial lift is to the structure containing the fire because of the smoke.

The present invention adds a piercing nozzle to the boom which has a hardened steel point and a sprayer unit that enables the piercing nozzle to be forced through the wall of the structure containing the fire so that the flame-retardant fluids may be injected directly into the interior of the structure. In addition, a heat sensor is mounted on the end of the boom assembly, so that it can be used to scan the object containing the fire and determine where the hot spots are located. The piercing nozzle can then be directed towards the hot spots and pierce the structure so that the fire retardant fluids can be injected into the interior of the container at the proper locations.

While the most efficient means of forcing the piercing nozzle through the wall of a structure is to align the upper boom perpendicular to the penetration point with the piercing nozzle parallel with and in axial alignment with the boom, the piercing nozzle may hit an obstruction that is difficult to pierce. It may tend to force the piercing nozzle to form an angle with the boom which will then create side forces perpendicular to the longitudinal axis of the piercing nozzle and if force is continued to be applied, damage may occur to the piercing nozzle, the mount on which it is positioned or the drive means that is tending to resist the side movement of the forces on the piercing nozzle. Therefore, a slip clutch is mounted between the outer end of the boom and the drive means such that the undesirable side forces on the elongated piercing nozzle are limited to a predetermined value in the Y plane perpendicular to the piercing direction of the elongated nozzle. This will protect the piercing nozzle, the mounting apparatus and the drive means from damages.

Also, because the structure containing the fire may be surrounded with thick smoke so that the operator cannot see the container, an acoustic proximity system is placed on the end of the boom to detect the position of the end of the boom relative to the structure as it is approaching the structure, even though the structure cannot be seen.

Further, a video camera is mounted on the outer end of the boom so that the operator can raise the boom and the aerial lift high above the structure containing the fire and can scan the area about the structure so that the picture can be transmitted back to the operator in the cab of the vehicle thereby ensuring that all information necessary to the containment of the fire can be available to the operator.

Finally, the present invention overcomes the disadvantages of the prior art by having a remote electronic control of the fluid flow quantity by restricting an orifice and simultaneously controlling the flow pattern by varying the orifice fluid flow direction. This control is accomplished by switches in the cab that can be mounted as needed.

The present invention also allows the upper boom to be tipped upwardly approximately 45° above horizontal and to be tilted downwardly to a point just above the cab of the vehicle. In this position, extension of the upper boom will position the nozzle device in various positions below the horizontal plane to address a variety of tasks. By extending the boom, the nozzle can be lowered to ground level or below ground level if necessary to reach over embankments, bridges or piers. The nozzle itself has the capability of rotating 90° either side of the center line of the boom. This allows the nozzle to be rotated 180° in the horizontal plane. In addition, the nozzle can be rotated plus 45° above the center line of the boom and minus 180° below the center line of the boom for a total rotation in the vertical plane of 225°. This unique feature makes positioning of the vehicle less critical in respect to a fire.

Thus, it is an important aspect of the present invention to provide a movable boom which can be elevated not only above the horizontal but can also be tipped downwardly below the horizontal and extended to the point that a nozzle on the outer end thereof can be lowered to or below ground level.

It is also an important aspect to the present invention to have a nozzle that can operate in both the horizontal plane and vertical plane with respect to the center line of the boom thereby enabling the nozzle to be extended into a doorway, for example, of a building or a vehicle and the nozzle rotated in both horizontal and vertical planes to extinguish a fire on the inside of the object.

SUMMARY OF THE INVENTION

Thus, the present invention relates an aerial boom system for a fire-fighting vehicle comprising an elongated boom mounted on the vehicle, power means for selectively raising and lowering the boom to a desired location, a conduit on the vehicle for carrying a flowable fire-retardant material to the outer end of the boom, an elongated hollow piercing nozzle coupled to the conduit and having a tapered point with at least one orifice therein for expelling the fire-retardant material, mounting means on the outer end of the boom for supporting the hollow piercing nozzle, drive means coupled to the mounting means for independently moving the hollow piercing nozzle in both a horizontal and a vertical plane, and the piercing nozzle extending beyond the end of the boom such that only the hollow piercing nozzle can be used to penetrate a wall of a structure from a remote distance and enable the fire retardant to exit the at least one orifice into the interior of the structure. Further, the piercing nozzle can be moved to a position where it is in substantial axial alignment with the boom for aligning the forces on the nozzle substantially parallel to the boom when piercing a structure thereby obtaining maximum piercing force with minimal side forces on the piercing nozzle. In addition, a slip clutch is mounted between the outer end of the boom and the drive means such that undesirable side forces on the elongated nozzle that may occur when piercing a structure are limited to a predetermined value in the Y plane perpendicular to the piercing direction of the elongated nozzle so as to protect the piercing nozzle, mounting and drive means from damage.

BRIEF DESCRIPTION OF THE DRAWINGS

These and other objects of the invention will be more readily understood when taken in conjunction with the accompanying specification and drawings in which drawings having like numerals represent like components and in which:

FIG. 10A is an elevation view of the novel aerial boom system illustrating the piercing nozzle on the outer end thereof and having associated therewith FIG. 10B which is a plan view of the movement of the boom in the horizontal plane;

FIG. 11 is a plan view of the aerial boom system on a vehicle approaching an aircraft and illustrating the ideal approach angle to be 90° to the surface that is to be pierced;

DETAILED DESCRIPTION OF THE DRAWINGS

Figure 1:
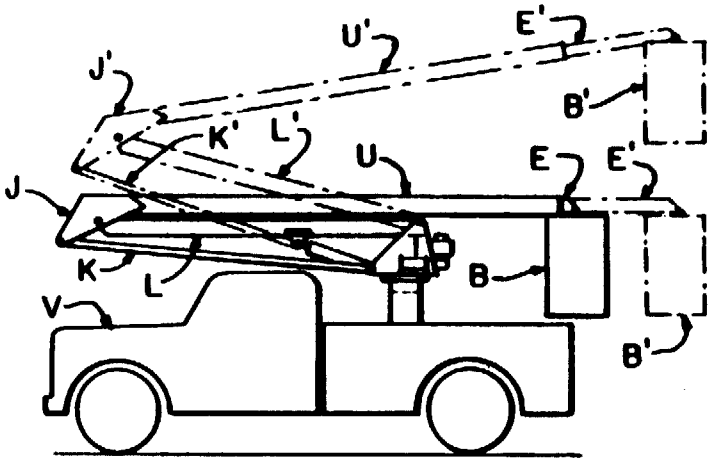
FIG. 1 PRIOR ART
FIG. 1 is a side elevation of a prior art aerial lift in storage position on a vehicle and showing certain other positions of parts thereof in phantom lines.

An aerial lift of the prior art is shown in FIG. 1 and may be mounted on a vehicle V as illustrated. The lift may include a turntable T conveniently rotatable 360° and on which a lower boom L and a pair of links K are pivotally mounted at different positions. A hydraulic cylinder C, which may be pivotally mounted to turntable T at the same position as the link K, is also pivotally attached to lower boom L to elevate the same. A knee joint J is mounted on and fixedly receives a portion of the inner end of upper boom U while both the lower boom L and the link K are pivotally connected to the knee joint J. A slightly modified parallelogram is formed by lines connecting the pivot points at the inner and outer ends of the lower boom and link. Thus, the parallelogram is formed by the lines between the outer pivot points of the lower boom and links and the inner pivot points of the lower boom and links, respectively. An extensible boom E is slidable outwardly and inwardly from an upper boom U while a workmen's cage or basket B is pivotally supported by the extensible boom. As in FIG. the extensible boom E may be moved outwardly to a position E' with the basket B thereby being moved to a position B'. Also the hydraulic cylinder C may be extended to move the lower boom L upwardly to a position L' which automatically moves the joint J to a position J' and the upper boom U to a position U' with the links K moving to a position K' and determining the angularity between the lower boom and the upper boom. It will be noted that the sides of the modified parallelogram formed by the lines between the above pivot points will remain the same in length, but the angles at the corners of the modified parallelogram will vary when the lower boom is raised to the position as indicated by the phantom lines from the stored position shown in FIG. 1. As can be seen in FIG. 1, as the lower boom L is raised, the upper boom U can never be moved to a position below the horizontal and in fact moves increasingly above the horizontal as the lower boom L is moved upwardly about its pivot point on the turntable T.

Figure 2:
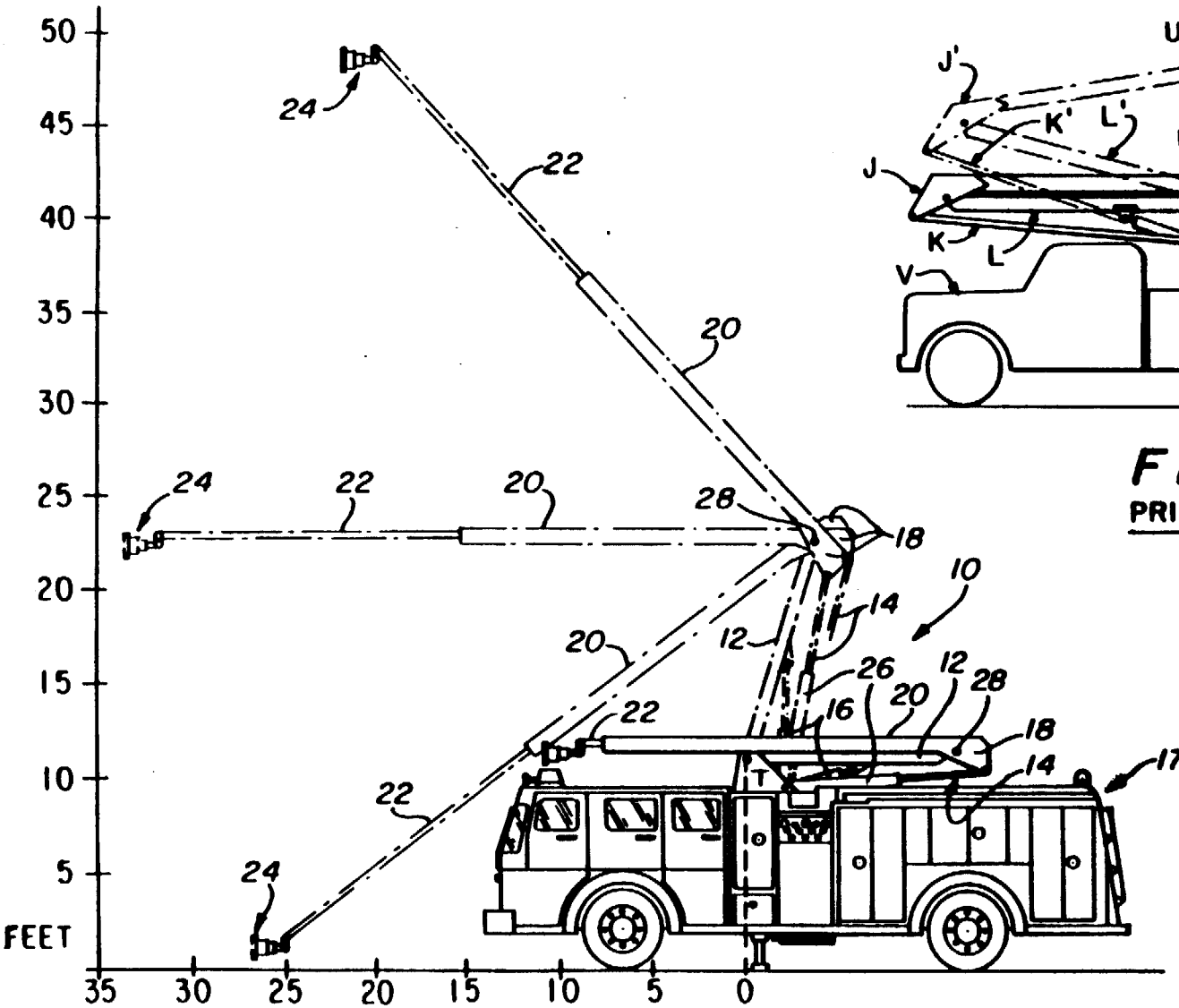
FIG. 2 is a side elevation of the novel aerial lift of the present invention again showing the storage position on a vehicle and illustrating certain other positions of the boom available with the present invention.

The present invention is disclosed in detail in FIG. 2 and illustrates a vehicle 10 that may include a turntable T, conveniently rotatable 360° about a vertical axis, on which a lower boom 12 and a pair of links 14 are pivotally mounted at different positions. A hydraulic cylinder 16, which may have one end pivotally attached to the turntable T at the same position as the links 14, is also pivotally attached at the other end to the lower boom 12 to elevate or lower the same. A knee joint 18 is rigidly mounted on, or may be integrally formed with, a portion of the inner end of an upper boom 20. Both the lower boom 12 and the links 14 are pivotally connected to the knee joint 18 at spaced locations. An extensible boom 22 is slidable outwardly and inwardly within the upper boom 20. A nozzle assembly 24 is pivotally supported by the extensible boom 22. When at rest, the lower boom 12 and the upper boom 20 are nested on top of the vehicle 10 as illustrated in FIG. 2. As piston 16 is actuated to move lower boom 12 upwardly, the upper boom 20 has a tendency to move as disclosed by the prior art device in FIG. 1 because of link 14.

Figure 4:
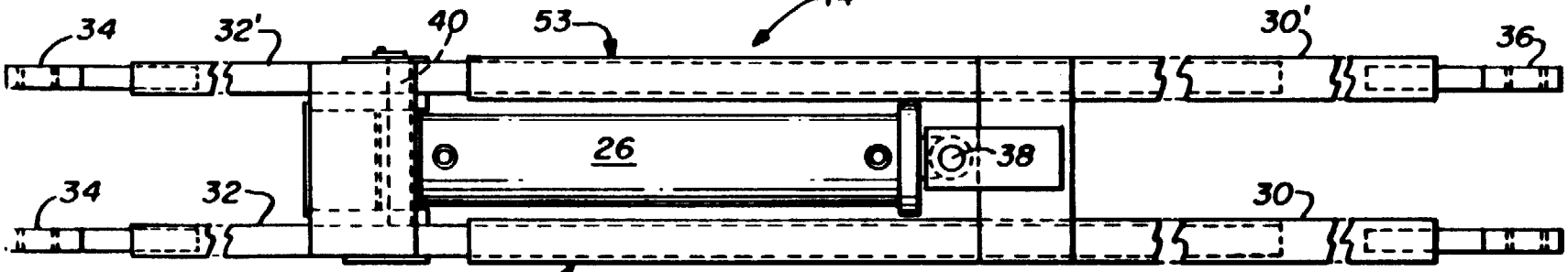
FIG. 4 is a top or plan view of the variable length link means of the present device.
Figure 5:
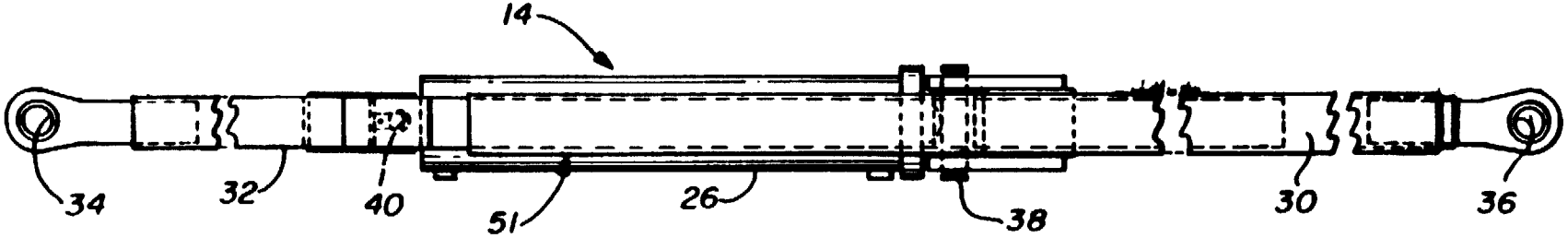
FIG. 5 is a side elevation of the novel variable length link means of the present invention.

In the present invention, link 14 has a selectively variable length and is formed in two sections slidable within each other as will be seen more clearly hereafter in relation to FIGS. 4 and 5. A hydraulic piston 26 couples the outer end of links 14 which are coupled to the knee joint 18 with the lower end of links 14 which are coupled to the turntable T. As the hydraulic cylinder 26 is actuated, the length of the links 14 changes, thus pivoting the upper boom 20 about pivot point 28 and causing the upper boom 20 and its extension 22 to be moved upwardly or downwardly as indicated in FIG. 2. As shown in FIG. 2, the existing unit can be pivoted upwardly a distance 50 feet above ground and downwardly until the nozzle assembly 24 is at ground level.

Figure 3:
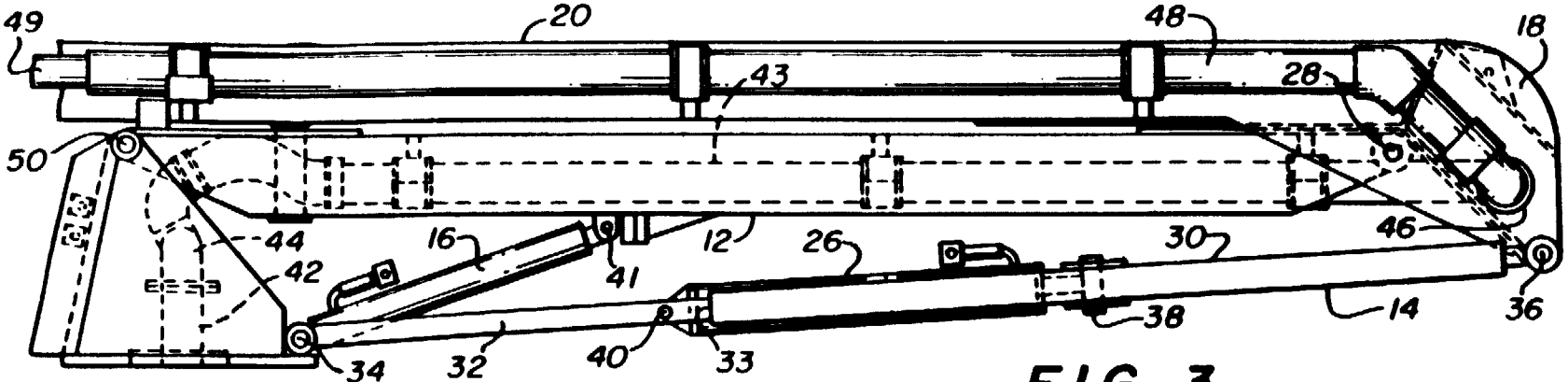
FIG. 3 is a partial side elevation of the upper and lower booms pivotally coupled together and the variable length link that is coupled between the inner end of the outer boom and the rotatable support on the vehicle.

As can be seen FIG. 3, the turntable T is rotatably mounted to the vehicle as described earlier. The link 14 has an outer end 30 and an inner end 32. The inner end 32 is pivotally attached to the rotatable turntable T at pivot point 34 while the outer end 30 of link 14 is attached to the knee joint 18 at pivot point 36. The hydraulic cylinder 26 is coupled at one end to the outer end 30 of the link 14 at point 38 while the other end of the hydraulic cylinder 26 is coupled to the inner portion 32 of link 14 at point 40. The inner portion 32 of link 14 is telescopically inserted on the inside of the outer portion 30 of link 14 as illustrated by joint 33. The hydraulic cylinder 16 is pivotally coupled at its inner end to the pivot point 34 on turntable T while its outer arm or rod is attached at point 41 to the lower boom 12. Upper boom 20 is pivotally attached at point 28 to lower boom 12. A water supply pipe 42 includes a swivel joint and receives water at the center point of the rotatable turntable T and passes it through a flexible hose 44 or any other desired connection to the outside of boom 12. It travels in a pipe 43 on the other side of boom 12 as shown in phantom lines to and is connected with the rotatable joint 46 in the knee joint 18. Joint 46 couples pipe 43 to the fluid pipe 48 which continues longitudinally on the outside of upper boom 20 to carry fluid such as water to the nozzle assembly 24 on the outer end of boom 20. A pipe 49 is slidable within pipe 48 and is connected to extensible boom portion 22 for movement therewith. Thus, as the boom portion 22 moves inwardly and outwardly with respect to boom 20, pipe 49 moves inwardly and outwardly with respect to pipe 48. Thus, as can be seen in FIG. 3, when hydraulic cylinder 16 is actuated, lower boom 12 begins to pivot upwardly about pivot point 50 where its inner end is attached to turntable T. If link 14 does not change its length, movement of the lower boom will cause the upper boom 20 to pivot above pivot point 28, thus moving upper boom 20 away from lower boom 12 as illustrated in the prior art by FIG. 1. However, by varying the length of link 14 with piston 26, upper boom 20 can be pivoted about the point 28 with respect to lower boom 12 thus enabling the boom 20 to assume any of the positions illustrated in FIG. 2.

When the upper and lower booms 12 and 20 are in the bedded position illustrated in FIG. 2, they are positioned directly over the cab roof of the vehicle. The upper boom 20 can be extended approximately 16 feet in front of the cab while in the bedded position. This allows the operator to push any impending or approaching fire back away from the vehicle thus adding to the safety of the operating personnel. When the need arises to elevate the nozzle, the operator simply moves a single joystick hydraulic control in the vehicle cab in the proper direction to elevate the upper boom to a height of 50 feet or more with the existing unit. The nozzle device 24 is compact and versatile and can be positioned inside the door of an aircraft to deluge the interior if necessary. The tilt down feature of the boom allows the nozzle assembly 24 to be lowered to ground level. This feature will position the nozzle device in various positions below the horizontal plane.

As illustrated in FIG. 4, the variable length link assembly 14 includes a hydraulic cylinder 26 installed between the two telescopic pivot links 52 and 54. The link 52 includes an outer portion 30 and a telescoping inner portion 32. In like manner, link 54 includes an outer portion 30' and a telescoping inner portion 32'. The assembly 14 provides the capability to tilt the boom at an angle up to 40° below horizontal. The telescoping pivot links 52 and 54 are constructed of steel alloy testing at 46,000 psi or equal suitable material and is equipped with a bushing. The combination of articulation and tilt down allows the nozzle to be placed at ground level approximately 15 to 20 feet in front of the vehicle.

Figure 9:
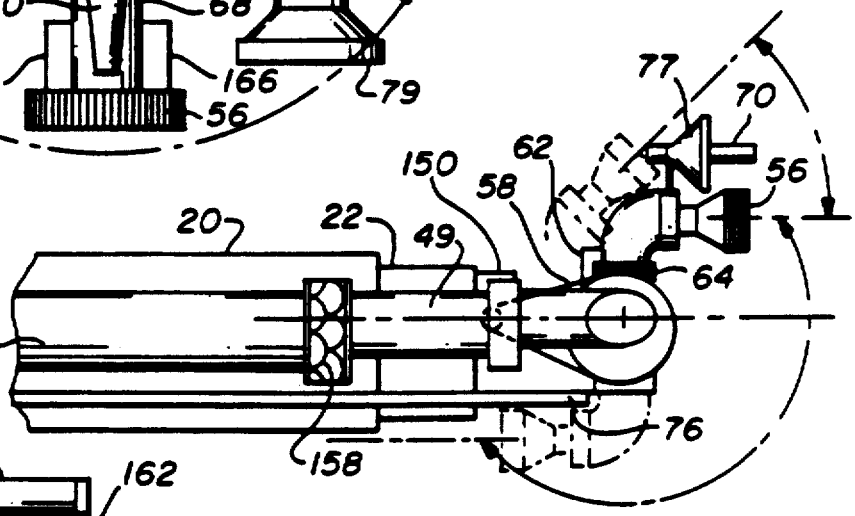
FIG. 9 is another side elevation of the novel nozzle assembly illustrating movement thereof in the vertical plane.

The upper boom 20 consists of a rectangular steel alloy tube outer section with an aluminum alloy telescoping inner section (or other materials suitable for the construction). The upper boom 20 is adequately reinforced to sustain all anticipated loads and nozzle reaction forces at full flow in all sweep directions. The extension and retraction of the upper boom is accomplished by a hydraulic cylinder providing a fully extended stroke of approximately 16 feet. The telescoping section is supported by phenolic pads for smooth, wear-free operation. Hydraulic hose and electrical lines are carried within a flexible tube support. All hydraulic hoses and electrical cables are contained inside the upper boom assembly 20 for maximum protection. The waterway piping system 48 shall be capable of flowing up to 1,000 gallons per minute with minimum friction loss. The waterway begins with a nominal 4-inch ID system containing a flexible connection at the base and extending along the lower boom section as light weight rigid tubing. The 4 inch waterway passes through the articulating section with the swivel assembly 46 and extends along the outside of the upper boom section 20. A 3¼ nominal ID telescoping waterway is provided on the upper boom assembly inside the 4-inch piping consisting of rigid tubing. Telescoping sections are sealed by special polypropylene glands 158 (FIG. 9). The waterway terminates with a 3-inch fitting for the nozzle sweep assembly 24.

Figure 6:
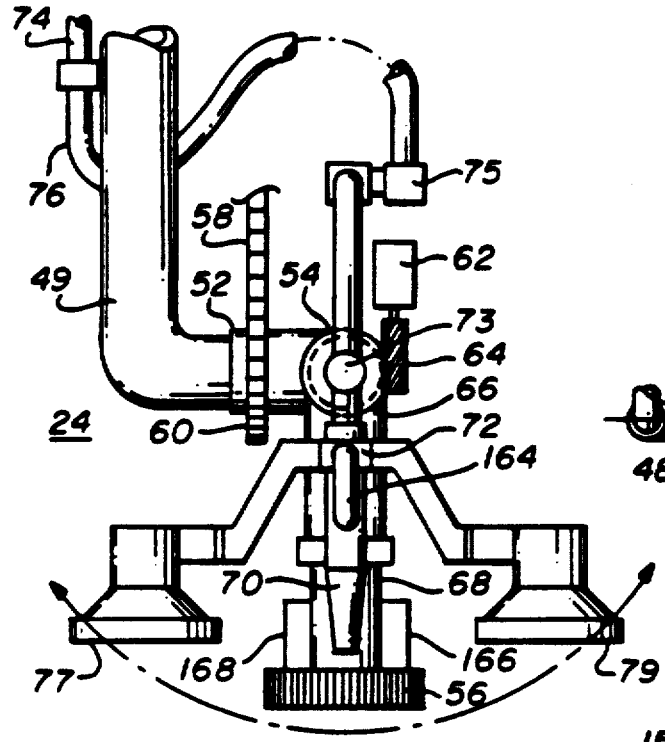
FIG. 6 is a top view of the novel nozzle used in the present invention.
Figure 7:
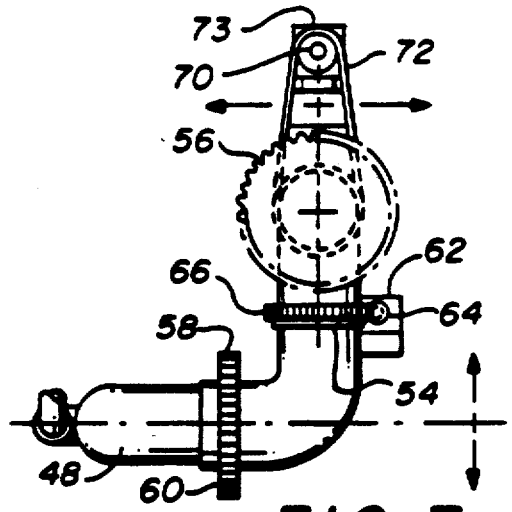
FIG. 7 is a front view of the nozzle illustrated in FIG. 6.
Figure 8:
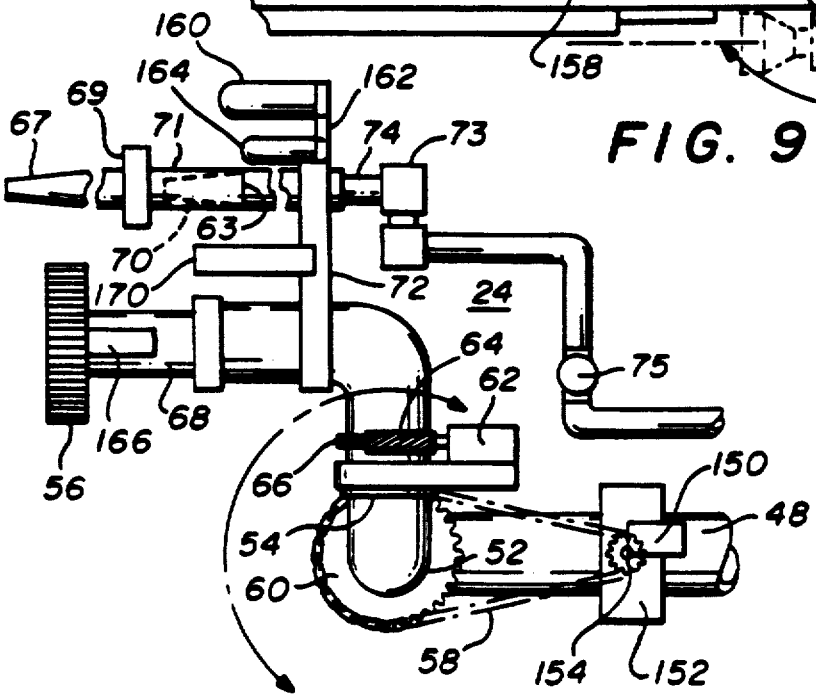
FIG. 8 is a side elevation of the novel nozzle illustrated generally in FIGS. 6 and 7.

The nozzle sweep assembly 24 consists of a 3 inch ID double swivel unit allowing the nozzle to sweep in both horizontal and vertical planes. Thus, as can be seen in FIGS. 6, 7 and 8, the waterway 48 turns at a first right angle and couples into a first swivel 52 and then turns a second right angle into a second swivel 54. The first swivel 52 has a sprocket 60 driven by a chain 58 which moves the nozzle 56 in a vertical plane with respect to the boom as can be seen best in FIG. 8. The drive system can cause the nozzle 56 to move upwardly above horizontal 45° and downwardly below horizontal 180° for a total movement of 225°. As can be seen in FIGS. 6, 8 and 9, a motor 62 drives a worm gear 64 that couples to gear 66 at the second swivel joint 54. Thus motor 62 can swivel the nozzle 56 90° in each direction from the axis of the boom for a total of 180°. The roller chain 58 rides on and is driven by a sprocket gear 154 which, in turn, is connected to an electric drive motor 150 through a gear box 152. Horizontal and vertical travel motions can be adjusted by placement of stops in the drive system that actuate a slip clutch in the drive motor.

If desired, a halon or other specific agent nozzle 70 may be attached by means 72 to the nozzle assembly 24 along side the water/foam nozzle 56. Nozzle 70 receives the agent from a supply tank 17 shown on the vehicle in FIG. 2. Piping consists of a stainless steel or equal telescoping tube 74. Stainless steel swivel fittings 73 and 75 similar to those described for the nozzle assembly 24 are installed to allow the auxiliary nozzle to rotate and elevate in conjunction with the movements of nozzle assembly 24. Flexible tube 76 couples telescopic tube 74 to swivel fitting 75.

If desired, instead of using the short halon nozzle 70, an elongated piercing nozzle 71 may be used. This nozzle has a piercing head 65, a sprayer unit 67 and a stop collar 69. The stop collar 69 may have an outside diameter of approximately 5 inches, while the nozzle 71 itself may have an outside diameter of 2 inches. These diameters are for example only and may vary. The stop collar 69 is rigidly attached to the nozzle 71 such as, for instance, by welding or being integrally formed therewith. The stop collar 69 sits just in front of nozzle 56. The purpose of the stop collar 69 is to protect the nozzle assembly when the piercing nozzle 71 is used to penetrate a structure wall or container. It is able to provide a stop which protects the nozzle 56 and its related elements by limiting the distance the piercing nozzle 71 can penetrate the structure wall. The nozzle 71 may use any special agents, such as halon or dry chemicals in conjunction with the piercing point 65 and the spray unit 67. Thus, the operator can approach an object or structure on fire, such as an airplane, and extend the boom with the piercing nozzle extending in the front thereof and penetrate the fuselage wall to spray the fire retardant on the interior of the plane. The length of the nozzle 61 from the attachment point at 63 where it may be screwed to the tube 74 is approximately 24 inches. It may also extend in front of the stop collar 69 approximately 18 inches.

It may, of course, be impossible to tell where in a structure that hot spots are occurring simply by viewing the structure. By placing a heat sensor 164 on the nozzle assembly as illustrated in FIG. 8, the nozzle assembly on the end of the boom can be used to scan the fuselage or other structure to find the hot spots. When the heat sensor indicates the greatest amount of heat, the operator can then use the piercing nozzle 71 to penetrate the structure at that point to release the fire retardant chemicals. Heat sensor 164 may be of any well-known type in the art.

In addition, there are occasions when the structure cannot be seen visually because of clouds of smoke surrounding it. In that case, a proximity sensor 170 mounted on attachment means 72 can be utilized to give the operator an indication of the distance from the nozzle assembly to the structure. Thus, the operator, by using the heat sensor 164, can tell where the hot spot is without being able to see the structure. He can then extend the nozzle end of the boom into the smoke and utilize the proximity sensor 170 to determine the distance of the nozzle from the structure even though he cannot see the structure. The proximity detector may be of the type entitled "Ultra-Sonic Tattletale Safety System", a trademark for a system for use on vehicles. The heat sensor 164 may be of any type well known in the art and in particular such as the type sold under the trademark "Life Sight", which works on the principle of radiated heat. It "sees" heat and creates a small television heat image that allows the user to see through smoke, utilizing the fact that thermal energy is not blocked by smoke particles as is ordinary light. With this device, any object that is 0.5° F. different from the surrounding area can be detected.

In addition, there are times when the operator has forward vision blocked by an object of some type. For instance, it may be advisable to "see" on the other side of the fuselage of an airplane. With the present advice, as illustrated in FIG. 8, a video camera transmitter 160 is mounted on the mounting structure 72 so that the operator can raise the boom and position it in the vertical and horizontal planes to scan the area of concern. By raising the boom, and maneuvering the nozzle assembly, the camera can be caused to view areas and transmit pictures to a receiver in the vehicle so that the operator can "see" the entire area, thus aiding in the ability to control a fire. Again, the video camera 160 may be of any type well-known in the art which is controlled electrically in any well-known mariner from the cab of the vehicle.

Further, present nozzles used on the aerial assemblies do not have the capability of changing the flow quantity except by changing pressure. The only way to change it in the prior art is to simply change the volume of water flowing by restricting water flow through a valve on the side of the supply vehicle. In the present invention, nozzle 56 is of a type well-known in the art, but not used on remote aerial booms, that control flow quantity by restricting the orifice and control the flow pattern thereby varying the fluid flow direction through the orifice. Such a nozzle is sold by Feecon Corporation. In the present device, as seen in FIG. 6, electric driven motors 166 and 168 are mounted on each side of the nozzle pipe 68 and are electrically controlled from the cab. Electric motor 166 changes the orifice restriction of the Feecon Corporation nozzle to control the flow quantity of fluid at the output of nozzle 56. Electric motor 168, also operated from the cab in a well-known manner, controls the flow pattern by varying the direction of fluid flow through the nozzle. Thus it can be a fine spray pattern or a concentrated stream. Thus, the quantity of fluid flow can be controlled without changing the pressure.

Further, if desired, two combination flood/spot lights 77 and 79 with one million peak candle power each may be attached to the nozzle assembly 24. In that case each light has quartz halogen bulbs and operates on a 12 volt system. The lights may be remotely switched from spot to flood modes. The flood mode provides full 150° illumination. The complete system is weather proofed and the lights rotate and elevate with the nozzle movement to provide illumination of the water/foam stream or act as an independent remote controlled light tower. Provision has also been made to accommodate other electrically or pneumatically operated devices that may be located at or near the end of the boom.

FIG. 10A is an elevation view of a vehicle 180 on which an aerial boom 182 is mounted as previously described for movement in the vertical and horizontal planes. A piercing nozzle assembly 184 is mounted on the outer end thereof. FIG. 10B illustrates some of the possible horizontal movements of the boom 182 with the hollow piercing nozzle assembly 184 mounted on the outer end thereof. Note that the piercing nozzle itself is substantially in axial alignment with the boom 182.

FIG. 11 is a plan view that illustrates the ideal approach angle of the vehicle with the aerial boom system thereon for approaching an object such as an aircraft 186. In this case, there may be a fire on the inside of the aircraft 186 and the piercing nozzle on assembly 184 can be used to penetrate the fuselage and inject the fire-retardant material on the interior of the aircraft. Since the boom 182 is extensible, the hollow piercing nozzle can be used to penetrate the fuselage from a remote distance, thus offering some protection for the operator thereof.

Figure 12:
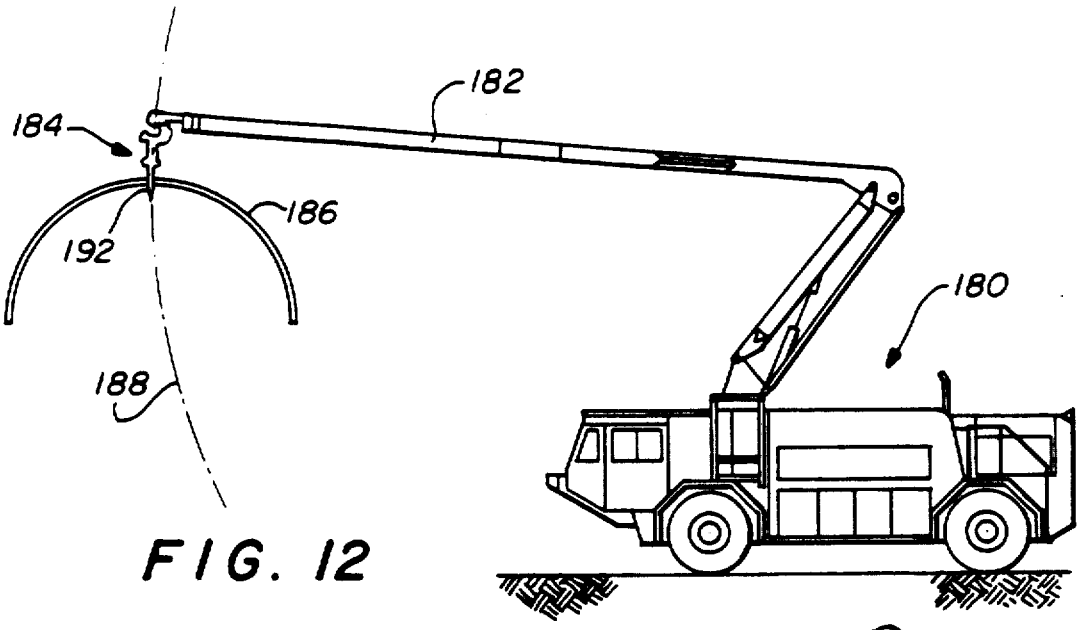
FIG. 12 is an elevation view of the novel boom system illustrating vertical penetration of a structure wall by the hollow piercing nozzle.

FIG. 12 illustrates the system where it is necessary to penetrate vertically into the top of a structure such as the fuselage of an aircraft. In that case, the hollow piercing nozzle assembly can be driven in a direction substantially perpendicular to the longitudinal axis of the boom 182 thus allowing the piercing nozzle to penetrate the upper portion of the fuselage as the tip of the boom follows an arc 188 in its downward movement.

Figure 13:
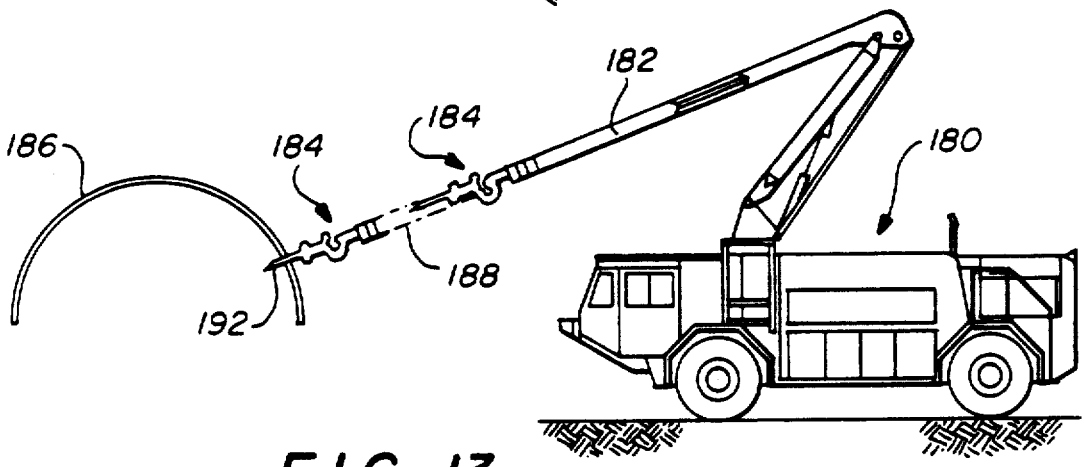
FIG. 13 is an elevation view of the boom system illustrating that the piercing nozzle is maintained parallel with the boom in its preferred operation with the upper boom aligned perpendicular to the point of penetration.

FIG. 13 is an elevation view of FIG. 11 that illustrates the preferred method of piercing a wall of a structure wherein the upper boom has its longitudinal axis substantially in alignment with the longitudinal axis of the hollow piercing nozzle and the piercing nozzle enters the fuselage 186 at right angles thereto. As the boom 182 is extended as illustrated by phantom lines 188, the extension force can be used to push the piercing nozzle of assembly 184 through the fuselage wall 186.

Figure 14:
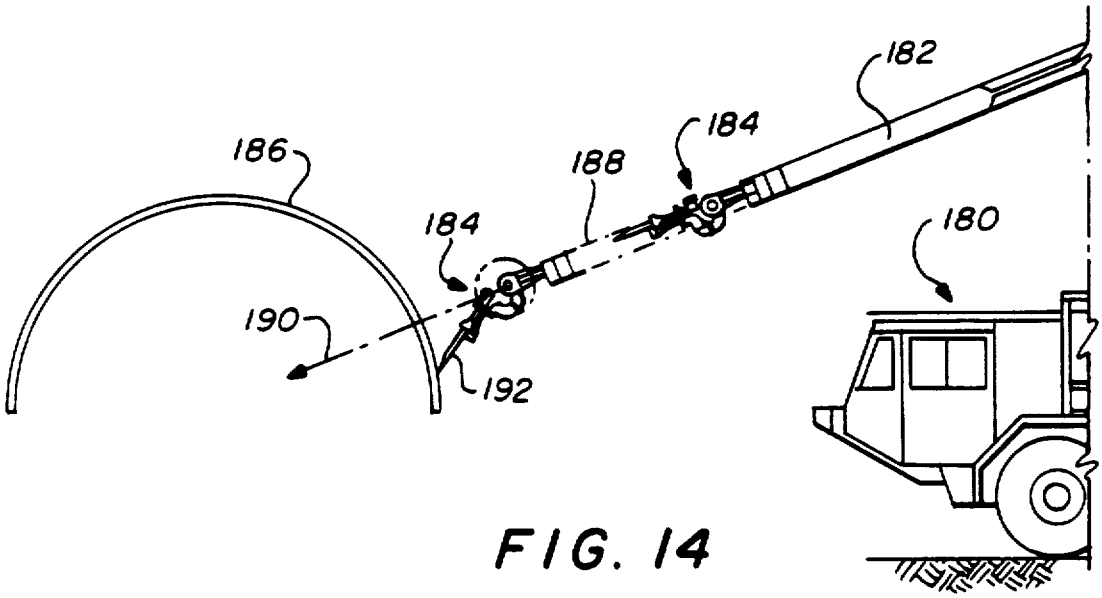
FIG. 14 is a partial elevational view illustrating the need for a safety device to release strain on the piercing nozzle assembly if the piercing nozzle hits an obstruction that is hard to pierce or if the piercing nozzle is not aligned parallel with the boom. In that case, a slip clutch will engage to prevent damage to the nozzle assembly components.

Referring now to FIG. 14, if the piercing nozzle assembly 184 should be out of axial alignment with the longitudinal axis of the upper boom 182 or if the piercing nozzle hits an obstruction in the fuselage 186 that is too hard to pierce, then continued force inwardly along arrow 190 would create transverse forces on the piercing nozzle assembly 184 that would tend to force it out of its fixed position and damage the piercing nozzle assembly, its mount or the drive means for driving the piercing nozzle in the vertical plane. Thus, a slip clutch assembly 204 is added between the outer end of the boom 182 and the drive means, as will be explained hereafter, to eliminate these undesirable forces and limit them to a predetermined value so as not to damage the piercing nozzle, its mounting or its drive means.

Figure 15:
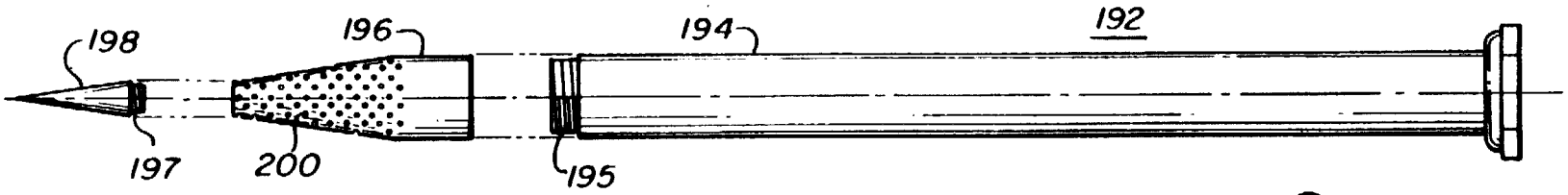
FIG. 15 is an exploded view of a hollow piercing nozzle illustrating the body, the portion of the tip with the orifices therein that is threadedly attached to the body and the piercing or penetrating tip that is threadedly attached to the portion of the piercing tip having the orifices therein.

FIG. 15 is an exploded view of a piercing nozzle 192. It has a body portion 194, a tapered portion 196 of a piercing tip that has orifices 200 therein and a penetrating tip 198. The tapered portion 196 of the piercing nozzle 192 is threadedly attached to the body portion 194 with threads 195. Threaded extensions may be inserted between the threads 195 and the tapered portion 196 of the piercing nozzle with the orifices 200 therein to obtain sufficient length to penetrate the wall of a particular object. The extensions may be 24 inches, 36 inches or 72 inches or any other desired size. This enables the piercing nozzle to be forced through a fuselage wall to the interior of an aircraft or other object and the retardant sprayed on the inside to extinguish the fire in that area. It is possible then for firemen to enter that area, remove the tapered portion 196 of the piercing nozzle and attach their hose to the threads 195 to personally direct fire within an aircraft or other structure as needed. The outer portion 198 of the piercing nozzle is a penetrating tip preferably made of chrome and is threadedly attached to the portion 196 by means of threads 197. The entire piercing nozzle is threadedly attached to the piercing nozzle assembly by threads 195.

Figure 16:
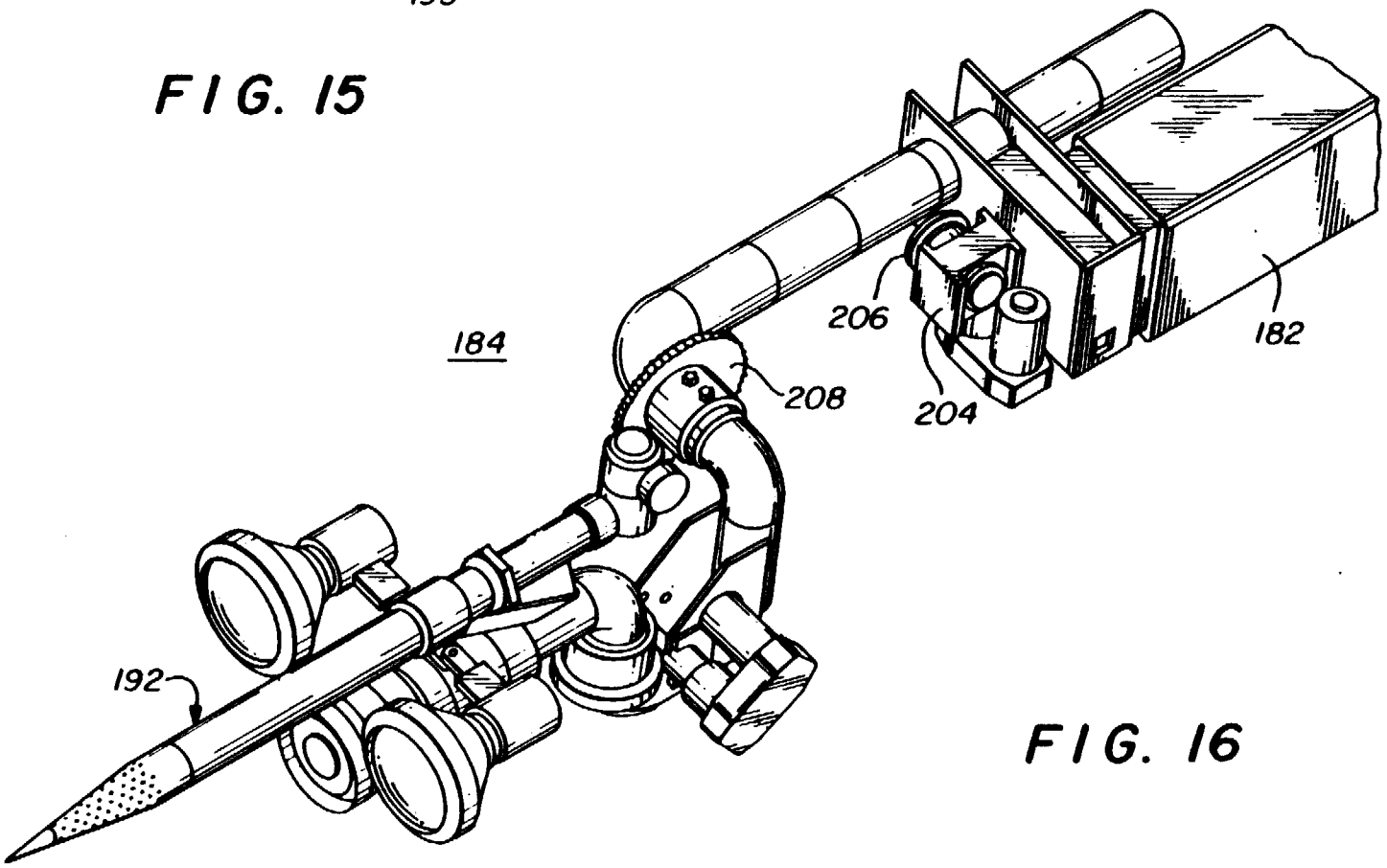
FIG. 16 is an isometric view of the piercing nozzle assembly mounted on the front end of the boom and illustrating the slip clutch mounted between the outer end of the boom and the drive means such that the undesirable forces on the elongated nozzle are limited to a predetermined value in the Y plane perpendicular to the piercing direction of the elongated nozzle.
Figure 17:
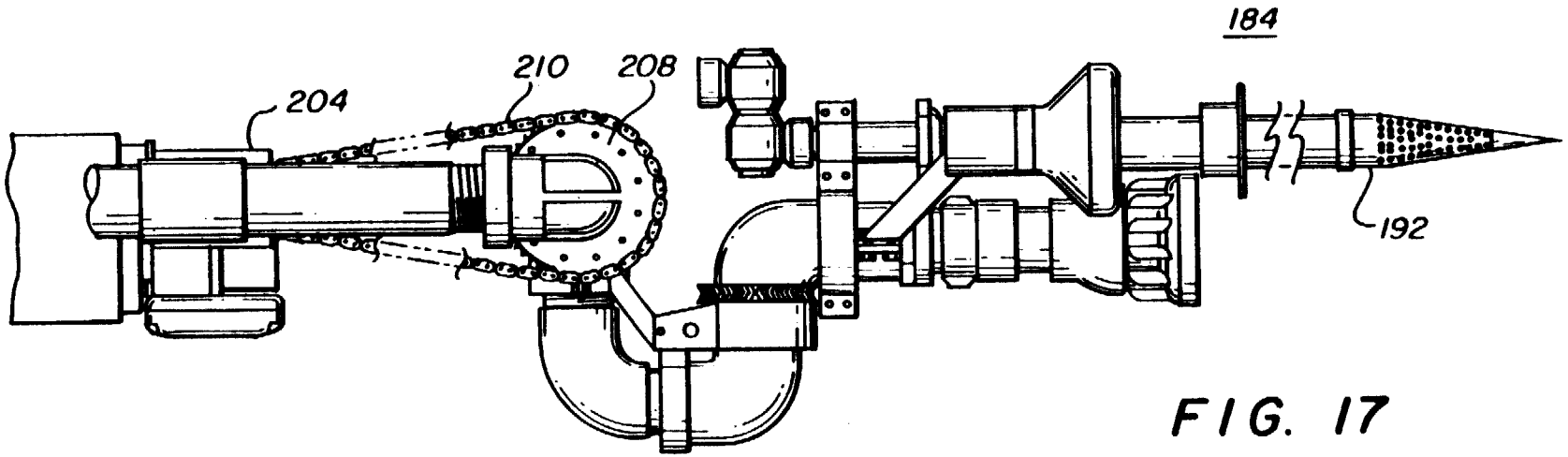
FIG. 17 is a side view of the nozzle assembly.

FIG. 16 is an isometric view of the piercing nozzle assembly 184. It is generally as described earlier in the present application with the exception that a slip clutch assembly 204 is added between the outer end of boom 182 and drive gear plate or wheel 206. Drive gear wheel 206 forms a part of the slip clutch assembly 204. A drive chain 210, shown in FIG. 17, is coupled between the gear plate or wheel 206 and the gear wheel 208 to move the nozzle 192 in the vertical plane. The slip clutch 204 is a torque limiter which is a protective device that limits torque transmitted in the drive system by slipping when the torque demand exceeds a preset value as a result of shock loads, overloads and the like. It automatically re-engages when the overload torque has passed. No resetting is required. Such a torque limiter is provided in the prior art under the designation Morse Torque Limiter. Thus, if the extensible boom 182 is moving inwardly as illustrated in FIG. 14 and the piercing nozzle 192 is forced out of alignment with the longitudinal axis of boom 182 as illustrated in FIG. 14, the torque applied by drive gear 208 to drive gear 206 through the chain 210 in FIG. 17 will cause slip clutch assembly 204 to operate and allow gear wheel 206 to slip thus freeing the entire hollow piercing nozzle assembly 184 and preventing damage to the components.

Figure 18:
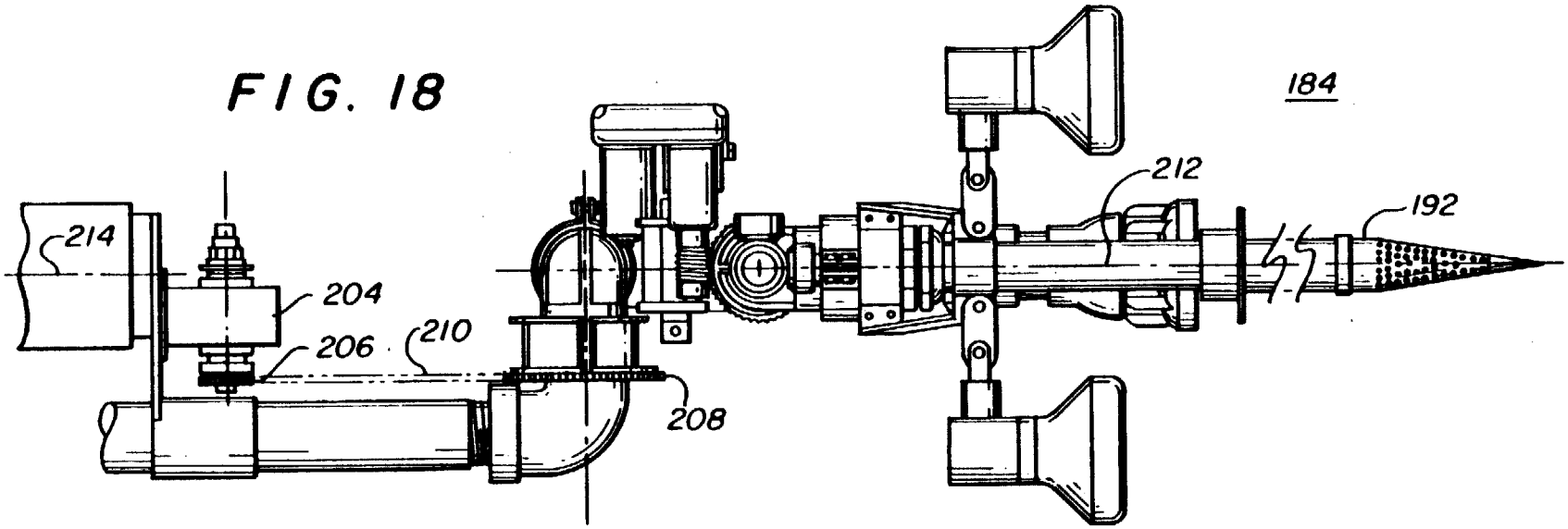
FIG. 18 is a top view of the nozzle assembly.

FIGS. 17 and 18 are side view and top view, respectively, of the novel hollow piercing nozzle assembly 184 shown in FIG. 16. It will be noted in FIG. 17 that a chain 210 is shown that couples the gear plates 206 and 208. It is also noticed in the top view in FIG. 18 that the center line 212 of the hollow piercing nozzle is aligned substantially with the longitudinal axis 214 of the upper boom assembly. This allows the forces to be applied to the hollow piercing nozzle in a manner to minimize side forces on the hollow piercing nozzle 192.

Thus, there has been disclosed a novel aerial boom system which allows a vehicle to be operated for a full range of responsibilities. The system is designed to be placed in operation during the roll in approach to a fire such as an aircraft incident and to begin discharging agent on the fire without restricting the mobility of the vehicle. The engine driven or P.T.O. driven hydraulic system allows the nozzle to be operated without disruption of the vehicle normal operation. When the vehicle is responding to a normal incident where there is no need to elevate, the all electric control nozzle can be utilized much like a standard roof mounted turret. Joystick controls simplify the operation. Joysticks incorporate potentiometers to allow proportional adjustment of hydraulic cylinders as is well known in the art. Capability is provided for preprogrammed boom/nozzle movements.

When the assembly is in the bedded position, it is positioned directly over the cab roof. The boom can be extended approximately 16 feet in front of the cab while in the bedded position. This allows the driver/operator to push any impending or approaching fire back away from the vehicle, thus adding to the safety of the operating personnel. When the need arises to elevate the nozzle, the operator simply moves a single joystick in the proper direction. Hydraulic pressure then elevates the boom to a height of 50 feet or more on existing models. The nozzle device is compact and versatile and can be positioned inside the doorway of an aircraft to deluge the interior if necessary. The additional halon or other auxiliary agent system gives greater depth to the overall performance. The halon auxiliary agent nozzle is attached to the water/foam nozzle and is positioned by utilizing the joystick control that moves the water/foam nozzle.

The nozzle has the capability of rotating 90° either side of the center line of the boom. This allows the nozzle to be rotated 180° on the horizontal plane. It can also be rotated in the vertical plane plus 45° above horizontal and minus 180° below horizontal in the vertical plane.

The two one million candle power spot/flood lights enhance nighttime capabilities. The power for the light is supplied by a switch on the instrument panel.

Auxiliary electric or pneumatic functions can be added to the end of the boom for other fire fighting or rescue operations.

Joystick controls are capable of proportional hydraulic cylinder movement and can be combined with other electronic components for preprogrammed nozzle/boom movements.

The tilt down feature of the nozzle allows the nozzle to be lowered to ground level. This feature positions the nozzle device in various locations below the horizontal plane to address a variety of tasks.

The piercing nozzle allows the operator of the boom to extend the piercing nozzle through the wall of a structure to inject the fire-fighting chemicals directly inside the structure containing the fire. The use of the stop collar prevents the nozzle assembly from being damaged by inserting the piercing nozzle too great a distance into the structure. Through the use of a heat sensor, the operator can scan the structure with the boom movements and the nozzle movements to find the hot spots. In addition, the heat sensor can locate the hot spots even though the structure is surrounded by heavy smoke. In addition, the proximity sensor can allow the operator, after locating the hot spots, to insert the piercing nozzle through the wall at that point, even though the wall cannot be seen because the proximity sensor indicates to the user the distance of the end of the boom from the structure. Also, the remote control of the nozzle by two electric motors allows the user to vary not only the volume of water being used, but also the flow pattern.

Further, the use of a slip clutch mounted between the outer end of the boom and the hollow piercing nozzle drive means enables undesirable forces on the elongated hollow nozzle that may occur when piercing a structure to be limited to a predetermined value in the Y plane perpendicular to the piercing direction of the elongated nozzle. This protects the piercing nozzle assembly, the mounting and the drive means from damages.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

We claim:

1. An aerial boom system for a fire-fighting vehicle comprising:

an elongated boom mounted on the vehicle;

power means for selectively raising and lowering the boom to a desired elevation;

a conduit on the vehicle for carrying a flowable fire-retardant material to the outer end of the boom;

an elongated hollow piercing nozzle coupled to the conduit and having a tapered point with at least one orifice therein for expelling the fire-retardant material;

mounting means on the outer end of the boom for supporting the hollow piercing nozzle;

drive means coupled to the mounting means for independently moving the hollow piercing nozzle in both a horizontal and a vertical plane;

the hollow piercing nozzle extending beyond the end of the boom such that the hollow piercing nozzle can be used to penetrate a wall of a structure from a remote distance and enable a fire-retardant to exit the at least one orifice into the interior of the structure; and a slip clutch mounted between the outer end of the boom and the drive means such that undesirable forces on the elongated nozzle that may occur when piercing a structure are limited to a predetermined value in the Y plane perpendicular to the piercing direction of the elongated nozzle so as to protect the piercing nozzle, mounting, and drive means from damage.

2. An aerial boom system as in claim 1 further comprising said piercing nozzle being attached to the mounting means such that the piercing nozzle can be moved to a position where it is in substantial axial alignment with the boom for aligning the forces on the nozzle substantially parallel to the boom when piercing a structure thereby obtaining maximum piercing force with minimal side forces on the piercing nozzle.

3. An aerial boom system as in claim 1 wherein the drive means moves the mounting means and hollow piercing nozzle to a desired position in X and Y planes for piercing a structure.

* * * * *